US009952002B2

(12) United States Patent
Wada et al.

(10) Patent No.: US 9,952,002 B2
(45) Date of Patent: Apr. 24, 2018

(54) HEAT TRANSFER FIN, HEAT EXCHANGER, AND REFRIGERATION CYCLE DEVICE

(71) Applicant: Panasonic Intellectual Property Management Co., Ltd., Osaka (JP)

(72) Inventors: Masanobu Wada, Osaka (JP); Masaaki Nagai, Osaka (JP); Tetsuya Masuda, Gunma (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 456 days.

(21) Appl. No.: 14/782,761

(22) PCT Filed: Apr. 7, 2014

(86) PCT No.: PCT/JP2014/001984
§ 371 (c)(1),
(2) Date: Oct. 6, 2015

(87) PCT Pub. No.: WO2014/167827
PCT Pub. Date: Oct. 16, 2014

(65) Prior Publication Data

US 2016/0047606 A1 Feb. 18, 2016

(30) Foreign Application Priority Data

Apr. 9, 2013 (JP) ..... 2013-081203

(51) Int. Cl.
*F28D 1/04* (2006.01)
*F28F 1/10* (2006.01)
(Continued)

(52) U.S. Cl.
CPC ..... *F28F 1/10* (2013.01); *F28D 1/0477* (2013.01); *F28F 1/32* (2013.01); *F25B 39/00* (2013.01);
(Continued)

(58) Field of Classification Search
CPC ..... F28F 1/10; F28F 2215/00; F28F 2240/00; F28D 1/0477; F28D 2021/007; F25B 39/00
(Continued)

(56) References Cited

U.S. PATENT DOCUMENTS 3,645,330 A * 2/1972 Albright ..... F28F 1/32 165/151
3,796,258 A * 3/1974 Malhotra ..... F28F 1/325 165/151
(Continued)

FOREIGN PATENT DOCUMENTS

JP 09-119792 5/1997
JP 09-303986 11/1997
(Continued)

OTHER PUBLICATIONS

International Search Report for PCT/JP2014/001984, dated Jul. 8, 2014, and English translation thereof, 2 pages total.
(Continued)

*Primary Examiner* — Claire Rojohn, III
(74) *Attorney, Agent, or Firm* — Hamre, Schumann, Mueller & Larson, P.C.

(57) ABSTRACT

A heat transfer fin (3) comprises a plate-like base section (4), a cylindrical collar section (5), a recessed section (7) which has a sloped surface (7*a*), and a flare section (6) which, when combined with another heat transfer fin (3), is in surface contact with the sloped surface (7*a*) of the another heat transfer fin (3). The sloped surface (7*a*) of the recessed section (7) and the root of the collar section (5) are connected, the connection portion where the sloped surface (7*a*) of the recessed section (7) and the collar section (5) are connected is bent at an acute angle, and the root of the collar section (5) reaches a position beyond a reference plane (S) which is in contact with a surface (4*a*) of the base section
(Continued)

(4), the surface (4*a*) being located on the side opposite the flare section (6).

7 Claims, 11 Drawing Sheets

(51) Int. Cl.
*F28F 1/32* (2006.01)
*F28D 1/047* (2006.01)
*F28D 21/00* (2006.01)
*F25B 39/00* (2006.01)

(52) U.S. Cl.
CPC .... *F28D 2021/007* (2013.01); *F28F 2215/00* (2013.01); *F28F 2240/00* (2013.01)

(58) Field of Classification Search
USPC ..... 165/151
See application file for complete search history.

(56) References Cited

U.S. PATENT DOCUMENTS 4,300,629 A * 11/1981 Hatada ..... F28F 1/325 165/151
4,691,768 A * 9/1987 Obosu ..... F28F 1/325 165/151
4,705,105 A * 11/1987 Cur ..... F28F 1/325 165/151
4,860,822 A * 8/1989 Sacks ..... F28F 1/325 165/151
4,923,002 A * 5/1990 Haussmann ..... F28F 1/32 165/151
5,056,594 A * 10/1991 Kraay ..... F28F 1/325 165/151
5,203,403 A * 4/1993 Yokoyama ..... F28F 1/32 165/151
5,207,270 A * 5/1993 Yokoyama ..... F28F 1/325 165/151
5,697,432 A * 12/1997 Yun ..... F28F 1/325 165/151
5,722,485 A * 3/1998 Love ..... F28F 1/325 165/151
5,775,413 A * 7/1998 Kawanabe ..... F28F 1/32 165/151
5,927,393 A * 7/1999 Richter ..... F28F 1/32 165/151
6,044,554 A * 4/2000 Potier ..... F28F 9/165 165/173
6,050,328 A * 4/2000 Shikazono ..... F28D 1/0477 165/121
6,209,201 B1 * 4/2001 Yamada ..... B21D 53/02 29/890.043
6,415,506 B1 7/2002 Baba et al.
6,928,849 B1 * 8/2005 Yamada ..... B21D 53/04 29/890.043
6,976,529 B2 * 12/2005 Kester ..... F28F 1/325 165/151
7,261,147 B2 * 8/2007 Oh ..... F28D 1/0477 165/151
8,973,647 B2 * 3/2015 Seo ..... F24F 13/30 165/151
8,978,743 B2 * 3/2015 Tamura ..... F24F 1/18 165/151
2004/0050539 A1 * 3/2004 Bemisderfer ..... F28D 1/0477 165/151
2004/0261984 A1 * 12/2004 Derosier ..... F28F 1/32 165/151
2005/0045316 A1 * 3/2005 Oh ..... F28F 1/32 165/150
2005/0056407 A1 * 3/2005 Oh ..... F28F 1/32 165/151
2008/0190588 A1 * 8/2008 Heidenreich ..... F28D 1/024 165/151

FOREIGN PATENT DOCUMENTS

JP 2000-051980 2/2000
JP 2008-232499 10/2008
JP 2010-169344 8/2010
WO 2008-114773 3/2008

OTHER PUBLICATIONS

European Search Report, dated May 3, 2016; European Patent Application No. 14783266.1 (7 pages).

* cited by examiner

HEAT TRANSFER FIN, HEAT EXCHANGER, AND REFRIGERATION CYCLE DEVICE

TECHNICAL FIELD

The present invention relates to a heat transfer fin, a heat exchanger using the heat transfer fin, and a refrigeration cycle apparatus in which a refrigeration cycle is configured with use of the heat transfer fin for heat exchange.

BACKGROUND ART

Conventionally, in refrigeration cycle apparatuses such as heat pump apparatuses, fin-tube type heat exchangers are often used. A fin-tube type heat exchanger has a configuration in which a heat transfer tube through which refrigerant flows is provided with a heat transfer fin to increase the heat transfer area.

FIG. 11 illustrates a configuration of conventional fin-tube type heat exchanger 100 disclosed in PTL 1. Heat exchanger 100 includes a plurality of stacked heat transfer fins 120 and heat transfer tube 110 that penetrates heat transfer fins 120.

Heat transfer fin 120 includes tubular collar part 123 (having a constant cross-sectional shape) that is provided in an upright state with respect to plate-shaped base part 121. From the root and an end of collar part 123, root part 122 and flare part 124 are expanded outward in the radial direction of collar part 123 while being curved.

The pitch of heat transfer fins 120 (interval between base parts 121) is defined when flare part 124 of one of two adjacent heat transfer fins 120 makes contact with base part 121 located near root part 122 of the other of heat transfer fins 120.

Normally, expansion of heat transfer tube 110 is performed in order to bring each heat transfer tube 110 into close contact with each heat transfer fin 120. To be more specific, heat transfer tube 110 having an outer diameter smaller than the inner diameter of collar part 123 is inserted in collar part 123 of stacked heat transfer fins 120. Thereafter, heat transfer tube 110 is expanded and thus heat transfer tube 110 and each heat transfer fin 120 are closely bonded together.

At the time of the expansion, heat transfer tube 110 contracts in the tube-axial direction. To prevent deformation of heat transfer fin 120 at this time, step part 125 is provided to increase the strength of heat transfer fin 120 in heat transfer fin 120 disclosed in PTL 1.

In heat transfer fin 120, root part 122 and flare part 124 are expanded while being curved, and therefore relatively large gap 130 is formed between collar parts 123 of heat transfer fins 120 adjacent each other.

When such a gap 130 is interposed, the contact area between heat transfer tube 110 and collar part 123 is small, and heat is not easily transmitted from heat transfer tube 110 to heat transfer fin 120. To solve such a problem, in PTL 2, gap 130 is filled with filler such as silicone resin to improve thermal conductivity.

CITATION LIST

Patent Literature

PTL 1
Japanese Patent Application Laid-Open No. 9-119792
PTL 2
Japanese Patent Application Laid-Open No. 2010-169344

SUMMARY OF INVENTION

Technical Problem

However, when gap 130 is filled with filler, segregation of the materials at the time of disposal of heat exchanger 100 is sacrificed. To be more specific, not only heat transfer tube 110 and heat transfer fin 120 made of metal, but also the filler made of a different material has to be handled as a waste material. Consequently, recycling efficiency is reduced and environment load is increased.

To solve such a conventional problem, an object of the present invention is to provide a heat transfer fin, a heat exchanger and a refrigeration cycle apparatus which have a large contact area between a heat transfer tube and a heat transfer fin without reducing recycling efficiency, and can efficiently discharge heat.

Solution to Problem

A heat transfer fin according to an embodiment of the present invention that is used for a heat exchanger includes: a plate-shaped base part; a collar part having a tubular shape that is provided in an upright state with respect to the base part; a recession part that includes an inclined surface configured to couple a root of the collar part with the base part; and a flare part that expands outward from an end of the collar part in a radial direction of the collar part over a whole circumference, the flare part being configured to make surface contact with an inclined surface of another heat transfer fin when the heat transfer fin is coupled with the other heat transfer fin used for the heat exchanger, wherein the inclined surface of the recession part and the root of the collar part are coupled with each other, a coupling part between the inclined surface of the recession part and the collar part is bent at an acute angle, and the root of the collar part is located at a position exceeding a reference surface that is in contact with a surface of the base part, the surface of the base part facing away from the flare part.

A heat exchanger according to an embodiment of the present invention that is a heat exchanger includes: a plurality of stacked heat transfer fins; and a heat transfer tube that penetrates the plurality of heat transfer fins, each heat transfer fin including: a plate-shaped base part, a collar part having a tubular shape that is provided in an upright state with respect to the base part, a recession part that includes an inclined surface configured to couple a root of the collar part with the base part, and a flare part that expands outward from an end of the collar part in a radial direction of the collar part over a whole circumference, the flare part being configured to make surface contact with an inclined surface of the recession part of another heat transfer fin when the heat transfer fin is coupled with the other heat transfer fin, wherein the inclined surface of the recession part and the root of the collar part are coupled with each other, a coupling part between the inclined surface of the recession part and the collar part is bent at an acute angle, and the root of the collar part is located at a position exceeding a reference surface that is in contact with a surface of the base part, the surface of the base part facing away from the flare part.

A refrigeration cycle apparatus according to an embodiment of the present invention has a configuration in which a refrigeration cycle is configured such that refrigerant circulates through a compressor, a condenser, a diaphragm apparatus and an evaporator, in which at least one of the condenser and the evaporator includes the heat exchanger.

Advantageous Effects of Invention

According to the present invention, without reducing recycling efficiency, the contact area between a heat transfer tube and a heat transfer fin can be increased, and heat can be efficiently discharged.

DESCRIPTION OF EMBODIMENTS

In the following, embodiments of the present invention are described in detail with reference to the accompanying drawings. It is to be noted that the present invention is not limited to the following embodiments.

Embodiment 1

Figure 1:
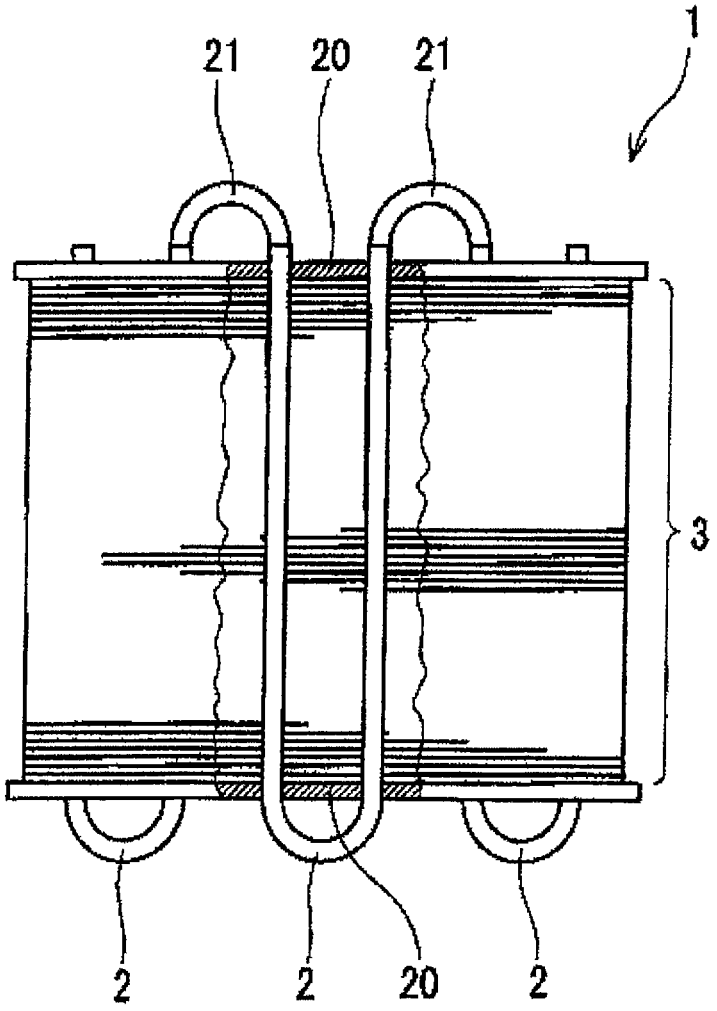
FIG. 1 illustrates an exemplary configuration of a heat exchanger according to Embodiment 1 of the present invention.

FIG. 1 illustrates an exemplary configuration of heat exchanger 1 according to Embodiment 1. Heat exchanger 1 includes a plurality of stacked rectangular-plate shaped heat transfer fins 3, a pair of side plates 20 disposed on the both sides of heat transfer fins 3, and a plurality of U-shaped heat transfer tubes 2 that penetrate heat transfer fins 3 and side plate 20 in a skewering fashion. Such a heat exchanger 1 is called fin-tube type heat exchanger.

Each heat transfer tube 2 has a cylindrical shape for example. The linear parts of heat transfer tubes 2 are disposed side by side with a predetermined interval therebetween in the longitudinal direction of heat transfer fins 3. In addition, the both ends of the linear part protrude from side plate 20. Ends of adjacent linear parts of heat transfer tube 2 are joined to each other with bend tube 21. For example, heat transfer tube 2 may be composed of a copper tube provided with internal grooves.

Figure 2:
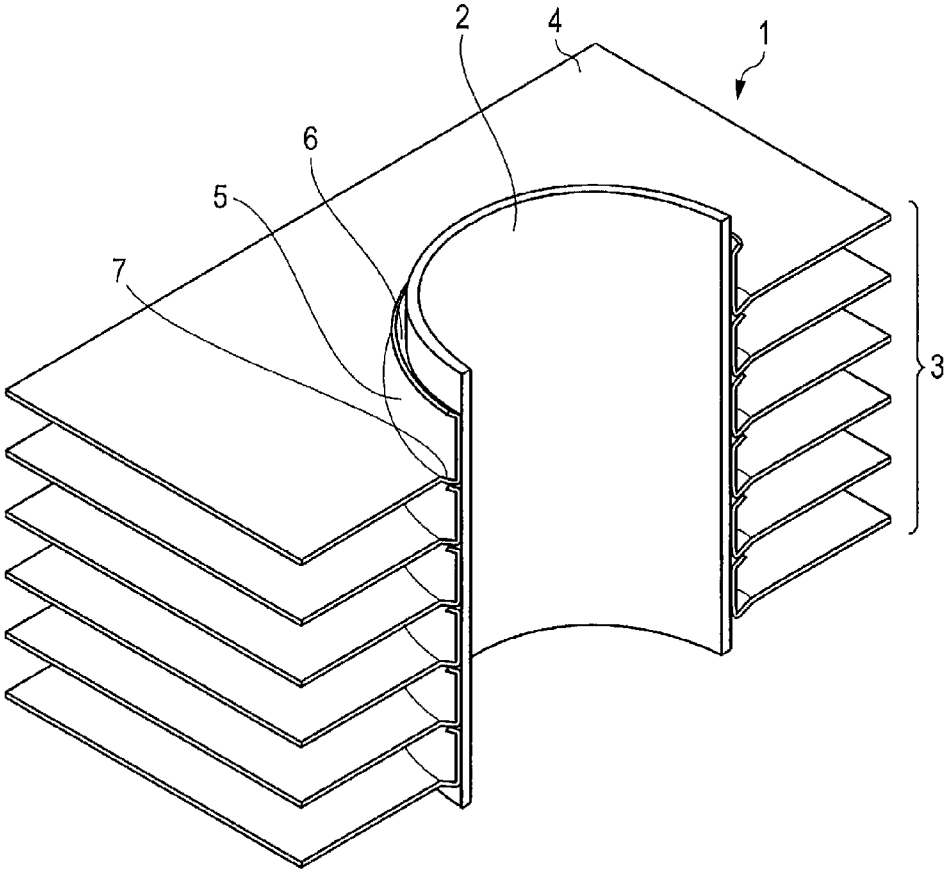
FIG. 2 is an enlarged perspective sectional view of the heat exchanger illustrated in FIG. 1.

FIG. 2 is an enlarged perspective sectional view illustrating heat exchanger 1 illustrated in FIG. 1. Rectangular plate-shaped heat transfer fins 3 illustrated in FIG. 2 are formed by pressing a thin aluminum plate, for example. Specifically, each heat transfer fin 3 includes base part 4 expanding around heat transfer tube 2 and tubular collar part 5 provided in an upright state with respect to base part 4.

Further, each heat transfer fin 3 includes flare part 6 and recession part 7. Flare part 6 is flared outward in the radial direction of collar part 5 from an end of collar part 5 over the whole circumference. Recession part 7 includes an inclined surface that couples the root of collar part 5 with base part 4.

When another heat transfer fin 3 is connected thereto, flare part 6 makes surface contact with an inclined surface of that heat transfer fin 3. In the following, for convenience of description, the direction from the root of collar part 5 coupled with recession part 7 to an end portion of collar part 5 coupled with flare part 6 is the upward direction, and the direction opposite to the upward direction is the downward direction.

When heat exchanger 1 is assembled, heat transfer fins 3 are stacked such that the central axes of collar parts 5 are aligned, and heat transfer tube 2 having an outer diameter smaller than the inner diameter of collar part 5 is inserted inside collar part 5. Thereafter, heat transfer tube 2 is expanded so that the outer peripheral surface of heat transfer tube 2 makes close contact with the inner peripheral surface of collar part 5.

With this configuration, heat exchange can be performed between the fluid flowing in heat transfer tube 2 and the fluid flowing between heat transfer fins. The fluid flowing in heat transfer tube 2 is R410A refrigerant used in a refrigeration cycle apparatus of a heat pump apparatus or the like, for example. In addition, the fluid flowing between heat transfer fins 3 is fluid such as air, for example.

Figure 11:
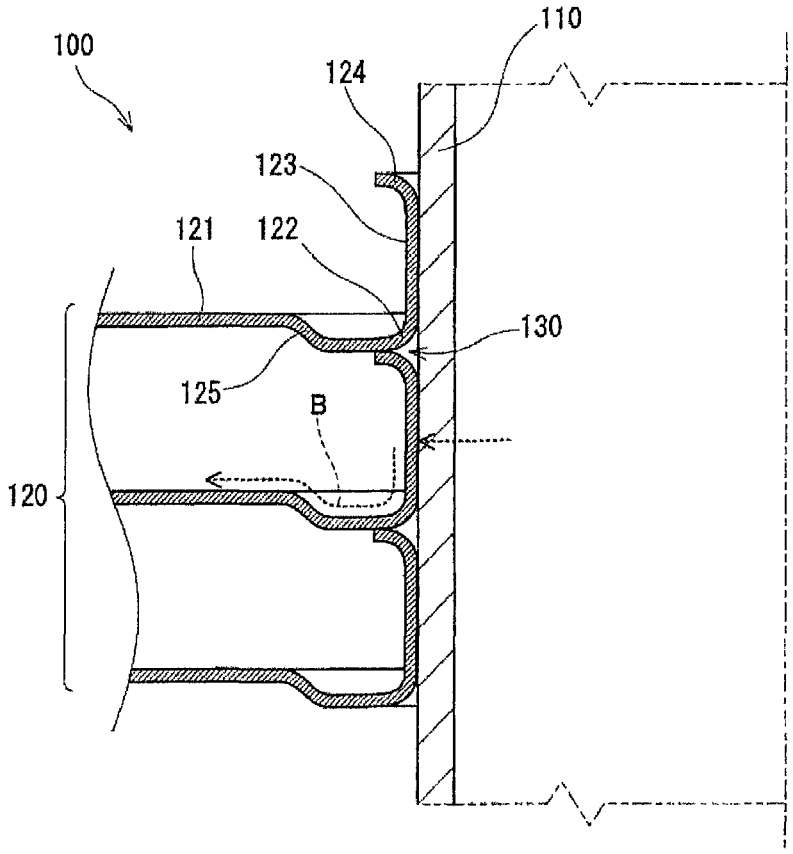
FIG. 11 illustrates a configuration of a conventional fin-tube type heat exchanger disclosed in PTL 1.

Next, with reference to the configuration of a conventional fin-tube type heat exchanger 100 illustrated in FIG. 11, a heat transfer phenomenon is described in detail.

As indicated by broken arrow B in FIG. 11, the heat of fluid flowing in heat transfer tube 110 is transmitted to the outer peripheral surface of heat transfer tube 110, and then transmitted from the outer peripheral surface to the inner peripheral surface of collar part 123, and further, transmitted from collar part 123 to base part 121. In addition, to the fluid flowing between heat transfer fins 120, the heat is transmitted from the outer peripheral surface of collar part 123 and the upper and lower surfaces of base part 121.

In general, the contact heat conductance at the time when heat is transmitted from the outer peripheral surface of heat transfer tube 110 to the inner peripheral surface of collar part 123 is defined by the following Expression 1.

[Expression 1]

$$K = \frac{1.7 \times 10^5}{\frac{\delta_1 + \delta_0}{\lambda_1} + \frac{\delta_2 + \delta_0}{\lambda_2}} \times \frac{0.6P}{H} \times \frac{10^6 \lambda_f}{\delta_1 + \delta_2} \qquad \text{Expression 1}$$

Definitions of the parameters are as follows.

K: Contact heat conductance ($W/m^2 \cdot K$)

$\delta_1$: The surface roughness of one member of the contact surface (μm)

$\delta_2$: The surface roughness of the other member of the contact surface (μm)

$\delta_0$: Contact length (=23 μm)

$\lambda_1$: The thermal conductivity of one member of the contact surface (W/mK)

$\lambda_2$: The thermal conductivity of the other member of the contact surface (W/mK)

P: Contact pressure (MPa)

H: The hardness of one of the members of the contact surface which has the hardness smaller than the other (Hb)

$\lambda_f$: The thermal conductivity of interposition fluid (W/mK)

With use of contact heat conductance K obtained by Expression 1, contact heat resistance Rc is calculated by Expression 2.

$$Rc=1/(K\times S) \quad \text{Expression 2}$$

Definitions of parameters are as follows.

Rc: Contact heat resistance (K/W)

S: Contact area ($m^2$)

As is clear from Expression 2, contact heat resistance Rc can be reduced by increasing contact heat conductance K, or by increasing contact area S.

The configuration disclosed in PTL 2 is one exemplary configuration for increasing contact heat conductance K. In this configuration, gap 130 between collar parts 123 facing heat transfer tube 110 is filled with a filler having a thermal conductivity $\lambda_f$ greater than that of air to increase contact heat conductance K.

In this configuration, however, recycling efficiency may be sacrificed as described above. To be more specific, environment load is increased due to decrease in recycling rate, increase in energy required for recycle, or the like.

In addition, today, efforts for reducing the impact on earth environment, such as home appliance recycling law, have been made by the government, and the number of the subjects for such efforts is increasing, and therefore the recycling efficiency is an important factor. In view of this, the above-mentioned configuration using filler has a problem.

In addition, examples of the configurations for increasing contact heat conductance K include a configuration in which surface roughnesses $\delta_1$ and $\delta_2$ of contact surfaces are reduced, a configuration in which contact pressure P is increased, a configuration in which thermal conductivities $\lambda_1$ and $\lambda_2$ of heat transfer tube 110 and heat transfer fin 120 are increased, and a configuration in which the hardness H of one of heat transfer tube 110 and heat transfer fin 120 which has a smaller hardness relative to the other is reduced.

In contrast, heat transfer fin 3 of the present embodiment is directed to increase contact area S, not contact heat conductance K. As is obvious from Expression 2, contact heat resistance Rc can be reduced by increasing contact area S between heat transfer tube 110 and collar part 123 even when contact heat conductance K is not changed.

When contact heat resistance Rc can be reduced, the thermal conductivity from heat transfer tube 110 to heat transfer fin 120 can be improved. That is, the heat exchange efficiency of heat exchanger 1 can be improved.

Figure 3:
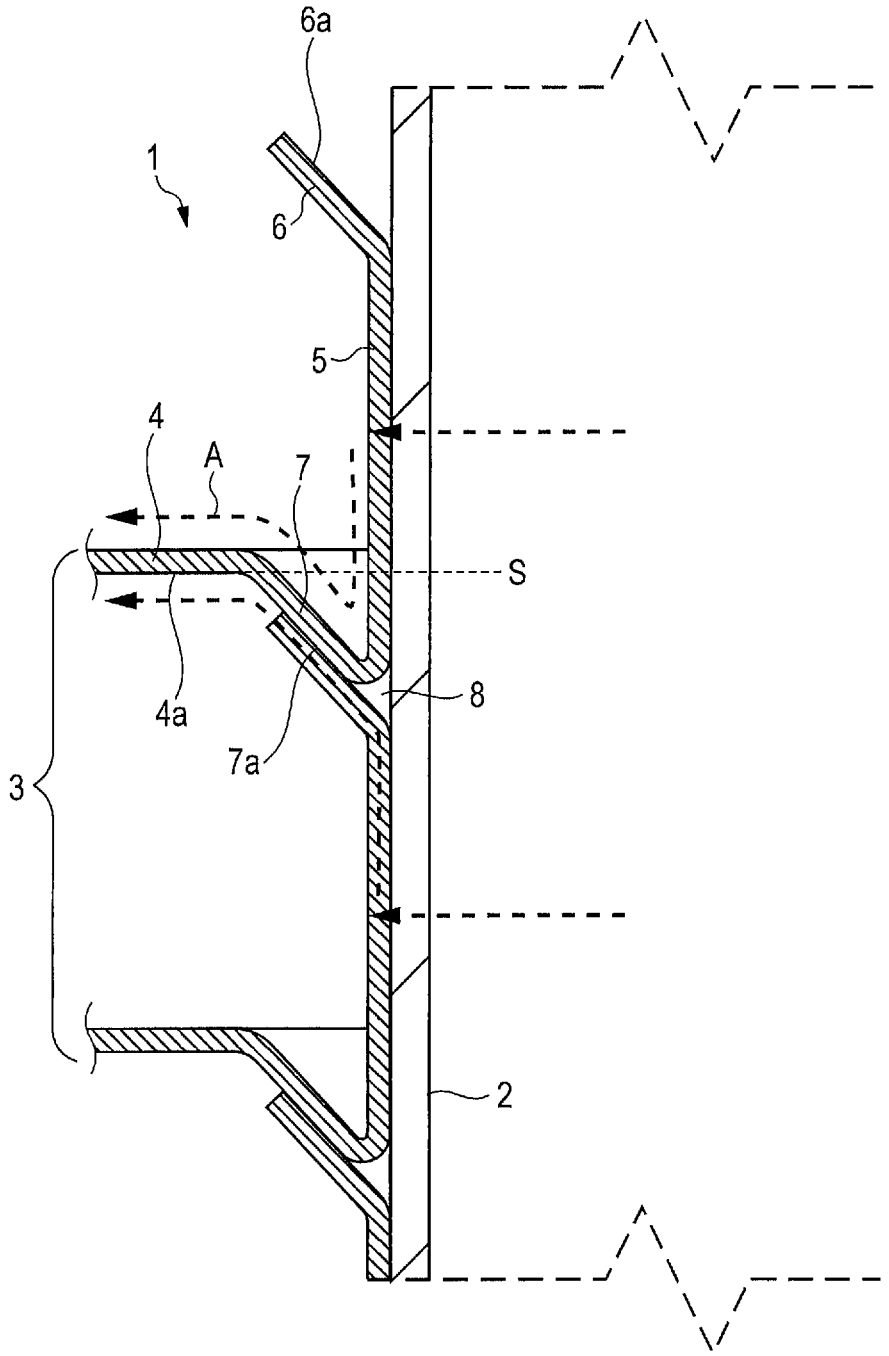
FIG. 3 is a sectional view illustrating a part of the heat exchanger illustrated in FIG. 1.

FIG. 3 is a sectional view illustrating a part of heat exchanger 1 illustrated in FIG. 1. As illustrated in FIG. 3, inclined surface 7*a* of recession part 7 and the root of collar part 5 are coupled to each other. Here, the coupling part of collar part 5 and inclined surface 7*a* of recession part 7 are bent at an acute angle. Further, the root of collar part 5 is located at a position lower than reference surface S in contact with surface 4*a* of base part 4 located on the side opposite to flare part 6.

As described above, in adjacent two heat transfer fins 3, recession part 7 of one of heat transfer fins 3 is put in the space defined by flare part 6 of the other of heat transfer fins 3, and makes surface contact with the flare part 6. Recession part 7 makes contact with flare part 6, and thus the pitch of heat transfer fins 3 (the interval between each base part 4) is defined.

As illustrated in FIG. 3 with broken arrow A, the heat transmitted from heat transfer tube 2 to collar part 5 is transmitted not only to base part 4 of heat transfer fin 3 having that collar part 5, but also to base part 4 of the adjacent heat transfer fin 3.

That is, as the transmission paths of heat from collar part 5 to base part 4, a path through which the heat is transmitted via recession part 7, and a path through which the heat is transmitted from flare part 6 to recession part 7 of the adjacent heat transfer fin 3 are ensured.

On the other hand, in conventional heat exchanger 100 illustrated in FIG. 11, an end of flare part 124 is in line contact with base part 121. With this configuration, the value of the heat transmitted through the line contacting part is extremely small.

Therefore, in conventional heat exchanger 100, as indicated with broken arrow B, the heat transmitted from heat transfer tube 110 to collar part 123 is transmitted only to base part 121 of heat transfer fin 120 having the collar part 123. That is, as the path through which heat is transmitted from collar part 123 to base part 121, only the path extending via root part 122 is provided.

For this reason, heat exchanger 1 of the present embodiment can efficiently transmit heat to base part 4 in comparison with conventional heat exchanger 100. Therefore, heat is easily transmitted from heat transfer tube 2 to heat transfer fin 3, and heat exchange efficiency can be improved.

In addition, since flare part 6 is provided to flare outward from an end of collar part 5 in the radial direction of collar part 5 over the whole circumference, the contact area between adjacent heat transfer fins 3 can be increased. Thus, heat can be efficiently transmitted to base part 4, and heat exchange efficiency can be improved.

Further, in two adjacent heat transfer fins 3, inclined surface 7*a* of recession part 7 of heat transfer fin 3 on the upper side and inclined surface 6*a* of flare part 6 of heat transfer fin 3 on the lower side make surface contact with each other. Since recession part 7 and flare part 6 make contact with each other in an oblique direction, the contact area between heat transfer fins 3 can be increased while limiting the lateral protruding amount of flare part 6 in comparison with conventional heat exchanger 100 illustrated in FIG. 11.

In addition, as described above, the root of collar part 5 is located at a position lower than reference surface S. That is, the contacting part between inclined surface 7*a* of heat transfer fin 3 on the upper side and inclined surface 6*a* of heat transfer fin 3 on the lower side is exposed to an air duct through which air flows between the heat transfer fins 3.

When air is guided between heat transfer fins 3 and an air duct is formed, the air at a position near heat transfer fin 3 has a temperature relatively higher than that of air at a center portion of the air duct because of heat dissipation from heat transfer fin 3. Therefore, when the contacting part is not located at a position lower than reference surface S, air having a high temperature that has flowed through a position near heat transfer fin 3 makes contact with the contacting part, making it difficult to achieve improvement in heat dissipation efficiency.

In particular, with recession part 7 of heat transfer fin 3 on the upper side and flare part 6 of heat transfer fin 3 on the lower side making contact with each other, the thickness at the contacting part is more than double the thickness of heat transfer fin 3, and the thermal capacity at the contacting part is large. In addition, the contacting part has a relatively high temperature since the contacting part serves as a heat resistance at the time when heat is transmitted from collar part 5 to base part 4 and the heat is further diffused from base part 4 to air.

For this reason, heat transfer fin 3 is formed such that the root of collar part 5 is located at a position lower than reference surface S, and thus the contacting part makes contact with air having a relatively low temperature that flows through the air duct at a center portion remote from the vicinity of heat transfer fin 3. With this configuration, the temperature difference between the contacting part and the air is large, and heat can be effectively dissipated, thus improving heat exchange performance.

In addition, when heat transfer fin 3 is formed such that the root of collar part 5 is located at a position lower than reference surface S, the bending acute angle of the coupling part of inclined surface 7*a* of recession part 7 and collar part 5 can be further reduced.

Consequently, the inclination angle of flare part 6 with respect to the tube-axial direction of collar part 5 can be reduced, and outward expansion of flare part 6 is reduced. As a result, at the time of forming flare part 6, it is possible to limit occurrence of crack at the coupling part of flare part 6 and collar part 5. Thus, heat transfer fin 3 can be easily formed.

It is to be noted that the shape of base part 4 may be a plate shape as illustrated in FIG. 3, or a corrugated-plate shape with protrusions and recesses. When base part 4 is formed in a corrugated plate-shape, it is preferable to provide a flat ring part between recession part 7 and base part 4.

While the coupling part of inclined surface 7*a* of recession part 7 and collar part 5 is bent at an acute angle as illustrated in FIG. 3, the depth of the groove in this state may be set in consideration of the efficiency of heat dissipation.

Figure 4:
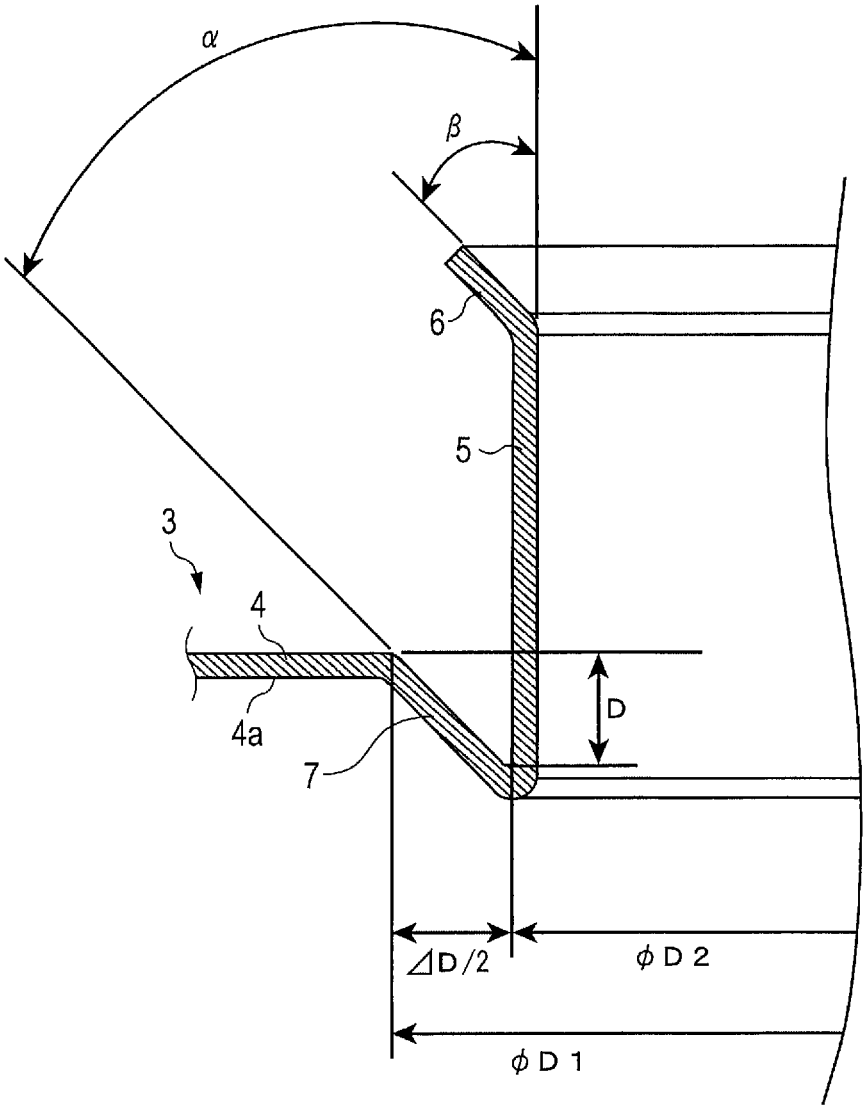
FIG. 4 illustrates dimensions of components of a heat transfer fin.

FIG. 4 illustrates the dimensions of the components of heat transfer fin 3. In FIG. 4, D represents the depth of the groove defined between collar part 5 and recession part 7, $\varphi D1$ represents the outermost peripheral diameter of the groove, and $\varphi D2$ represents the outermost peripheral diameter of collar part 5. The difference between the outermost peripheral diameter of the groove and the outermost peripheral diameter of the collar part 5, that is $\varphi D1-\varphi D2$ is represented by $\Delta D$. In this case, the width of the groove is $\Delta D/2$.

When depth D of the groove has a large value, air does not easily flow through a part near the bottom of the groove, and heat dissipation does not easily occur at that part. Therefore, it is desirable to set depth D of the groove in consideration of efficiency of heat dissipation.

Figure 5:
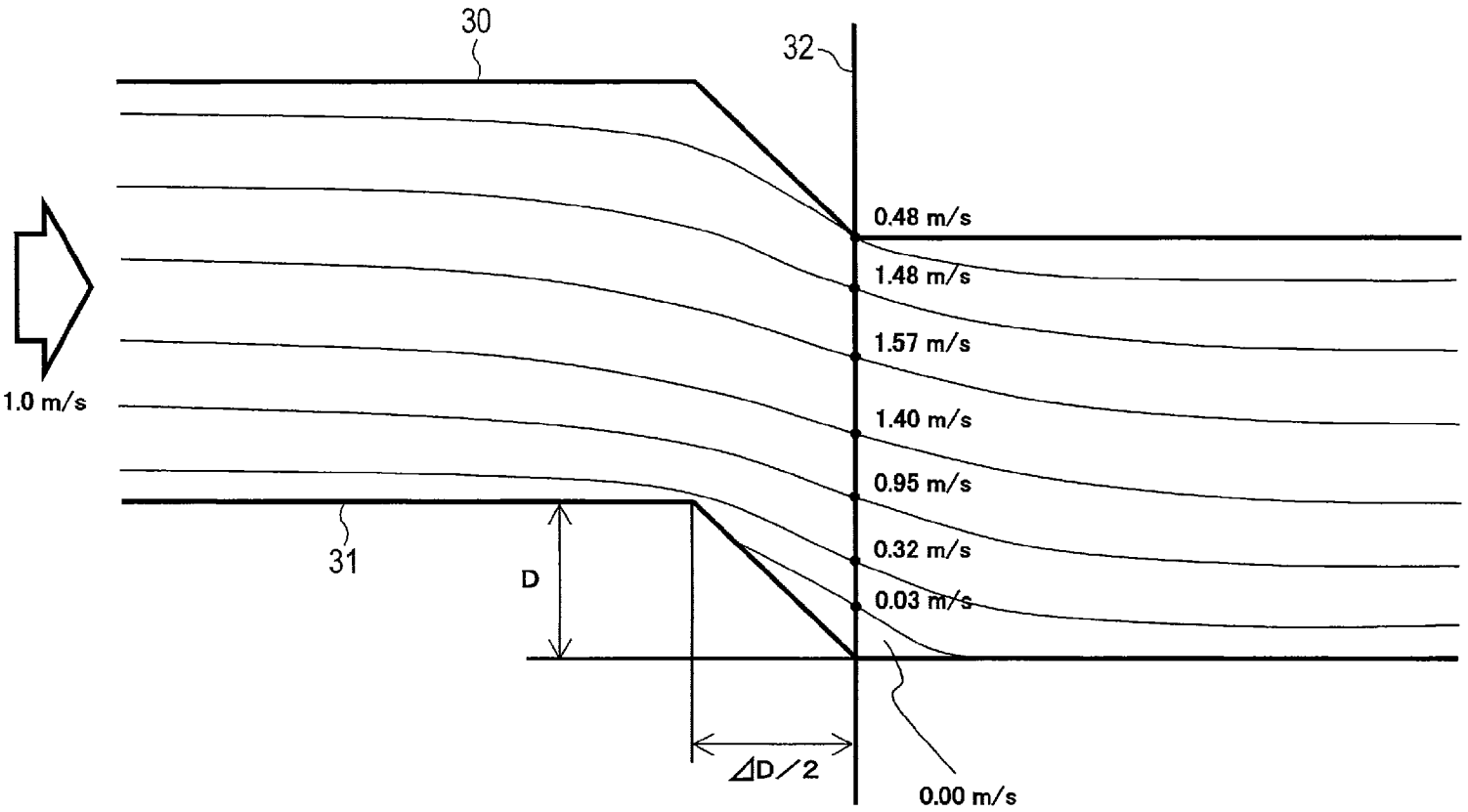
FIG. 5 shows a result of numerical analysis of air flow between the heat transfer fins.

FIG. 5 shows a result of numerical analysis of the flow of air between heat transfer fins 3. FIG. 5 shows a velocity distribution of air that flows at an air velocity of 1.0 m/s (initial air velocity of 1.0 m/s) from the left side of an air duct having a step, and flows out to the right side of the air duct.

The step corresponds to the groove between collar part 5 and recession part 7 illustrated in FIG. 4. FIG. 5 shows depth D of the groove illustrated in FIG. 4, and width $\Delta D/2$ of the groove. In this example, D and $\Delta D/2$ are each 0.5 mm.

In addition, in adjacent two heat transfer fins 3, upper boundary 30 of the air duct corresponds the bottom surface of heat transfer fin 3 on the upper side and lower boundary 31 of the air duct corresponds to the top surface of heat transfer fin 3 on the lower side. In addition, the interval between upper boundary 30 and lower boundary 31 of the air duct corresponds to the fin pitch. In the example illustrated in FIG. 5, the fin pitch is 1.34 mm.

In addition, in the numerical analysis, heat exchanger 1 having a three-dimensional shape is expressed as a two-dimensional model, and the three-dimensional air flow is approximated by a two-dimensional flow. That is, at the position of surface 32 of collar part 5 shown in FIG. 5, the direction of the actual air flow changes, and the air flows so as to turn around collar part 5.

This point is simplified in the two-dimensional model shown in FIG. 5, and values are calculated on the assumption that the direction of the flow does not change at the position of surface 32 of collar part 5. An object of the numerical analysis is to check whether a region exists where air does not flow at the bottom of the groove between collar part 5 and recession part 7. Such an object can be achieved with sufficient accuracy even with the above-mentioned approximation.

As shown in FIG. 5, when D and $\Delta D/2$ are each 0.5 mm, a region where the air velocity is 0 is formed at a position of a step in the proximity of lower boundary 31 of the air duct. This means that a region where air velocity is 0 is formed at the bottom of the groove between collar part 5 and recession part 7.

Figure 6:
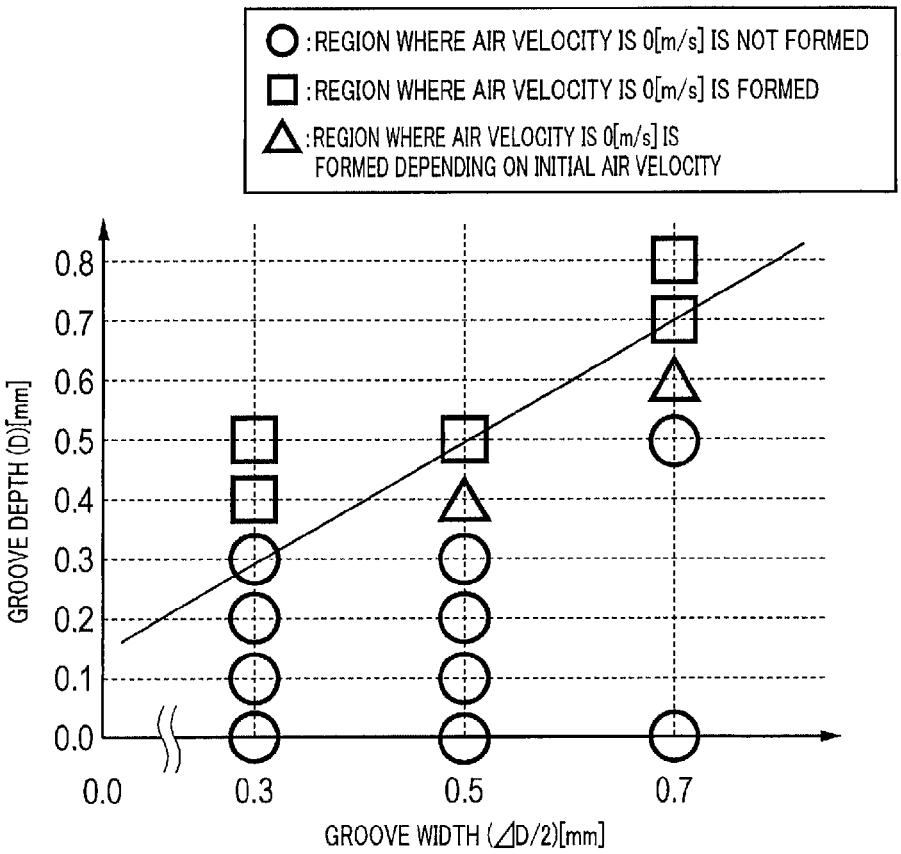
FIG. 6 shows a relationship among formation of a region where air velocity is 0, depth D of a groove, and width ΔD/2 of the groove.

FIG. 6 shows a result of the same numerical analysis of the values of D and $\Delta D/2$. FIG. 6 shows a relationship among formation of a region where the air velocity is 0, depth D of the groove, and width $\Delta D/2$ of the groove.

In FIG. 6, circles indicate that the region where the air velocity is 0 is not formed, squares indicate that the region where the air velocity is 0 is formed, and triangles indicate that the region where the air velocity is 0 is formed depending on the initial air velocity.

To be more specific, when D is 0.4 mm and $\Delta D/2$ is 0.5 mm, and, the initial air velocity is 2.0 m/s or greater, the region where the air velocity is 0 is formed. In addition, when D is 0.6 mm and $\Delta D/2$ is 0.7 mm, and, the initial air velocity is 1.0 m/s or greater, the region where the air velocity is 0 is formed.

It is clear from FIG. 6 that, when D satisfies the relationship of $D>\Delta D/2$, the region where the air velocity is 0 tends to be formed. In order not to form such a region, it is preferable that D be equal to or smaller than ($\Delta D/2$).

In this manner, heat is transmitted from the surface of collar part 5 to air also at the root of collar part 5, the therefore reduction in air-side heat transmission rate in heat exchanger 1 is not caused. In heat exchanger 1, the contact area between heat transfer tube 2 and heat transfer fin 3 has a large value to improve the thermal conductivity, and the effect of improving the thermal conductivity can be sufficiently achieved when decrease in air-side heat transmission rate is prevented.

It is to be noted that, in FIG. 4 and the like, heat transfer fins 3 in which inclination angle $\beta$ of flare part 6 with respect to the axis direction of collar part 5 is equal to inclination angle $\alpha$ of recession part 7 with respect to the axis direction of collar part 5 are coupled with each other. However, inclination angle $\beta$ before heat transfer fins 3 are coupled with each other is not limited to this, and may be smaller than inclination angle $\alpha$.

Figure 7:
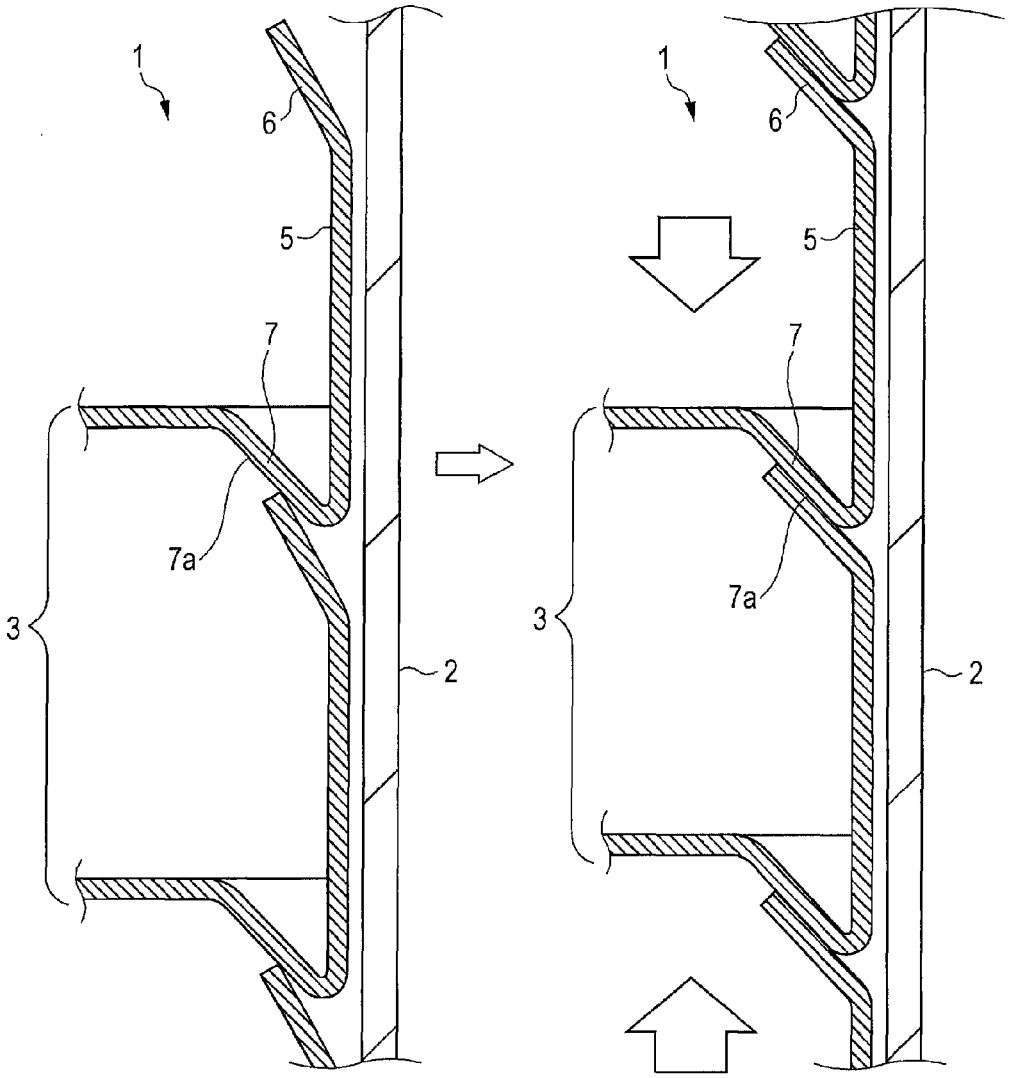
FIG. 7 illustrates an exemplary heat transfer fin in which an inclination angle of a flare part is smaller than an inclination angle of a recession part.

FIG. 7 illustrates an example of heat transfer fin 3 in which the inclination angle of flare part 6 is smaller than the inclination angle of recession part 7. When such heat transfer fin 3 is used in heat exchanger 1, first, heat transfer fins 3 are stacked on each other, and then heat transfer fins 3 are pressed along the axis direction of collar part 5.

In this manner, flare part 6 is pushed and expanded by recession part 7, and a state where flare part 6 and recession part 7 are in parallel to each other is finally established. In this manner, flare part 6 and recession part 7 make surface contact with each other and the contact area between heat transfer fins 3 is increased, thus making it possible to improve efficiency of heat transmission from collar part 5 of heat transfer fin 3 on the lower side to heat transfer fin 3 on the upper side.

Advantageously, in heat exchanger 1 having such a structure, gap 8 illustrated in FIG. 3 is not easily expanded even when heat transfer tube 2 is expanded (first effect). The reason for this is that recession part 7 is pushed by flare part 6, and the root of collar part 5 is firmly fixed between flare part 7 and heat transfer tube 2. In contrast, in conventional heat exchanger 100 illustrated in FIG. 11, gap 130 easily expands since the root of collar part 123 is not fixed.

In addition, as illustrated in the left part of FIG. 7, a heat exchanger is known in which recession part 7 makes contact with the upper end of flare part 6 to set the pitch of heat transfer fins 3. In such a heat exchanger, however, the gap between heat transfer fin 3 and heat transfer tube 2 is relatively large.

In contrast, since recession part 7 is pushed by flare part 6 in heat exchanger 1 of the present embodiment as described above, the gap is not easily expanded, and the contact area between heat transfer tube 2 and collar part 5 can be prevented from being reduced (second effect).

With the above-mentioned advantageous effects, in heat exchanger 1 of the present embodiment, contact heat resistance can be reduced, and thermal conductivity can be improved. As a result, the heat exchange efficiency of heat exchanger 1 can be increased. In addition, the above-mentioned advantageous effects can be achieved with heat transfer tube 2 and heat transfer fin 3, and other materials such as filler to be provided in the gap are not required, and therefore segregation at the time of disposal of heat exchanger 1 is facilitated. As a result, it is possible to prevent decrease in recycling efficiency and increase in environment load.

Embodiment 2

Figure 8:
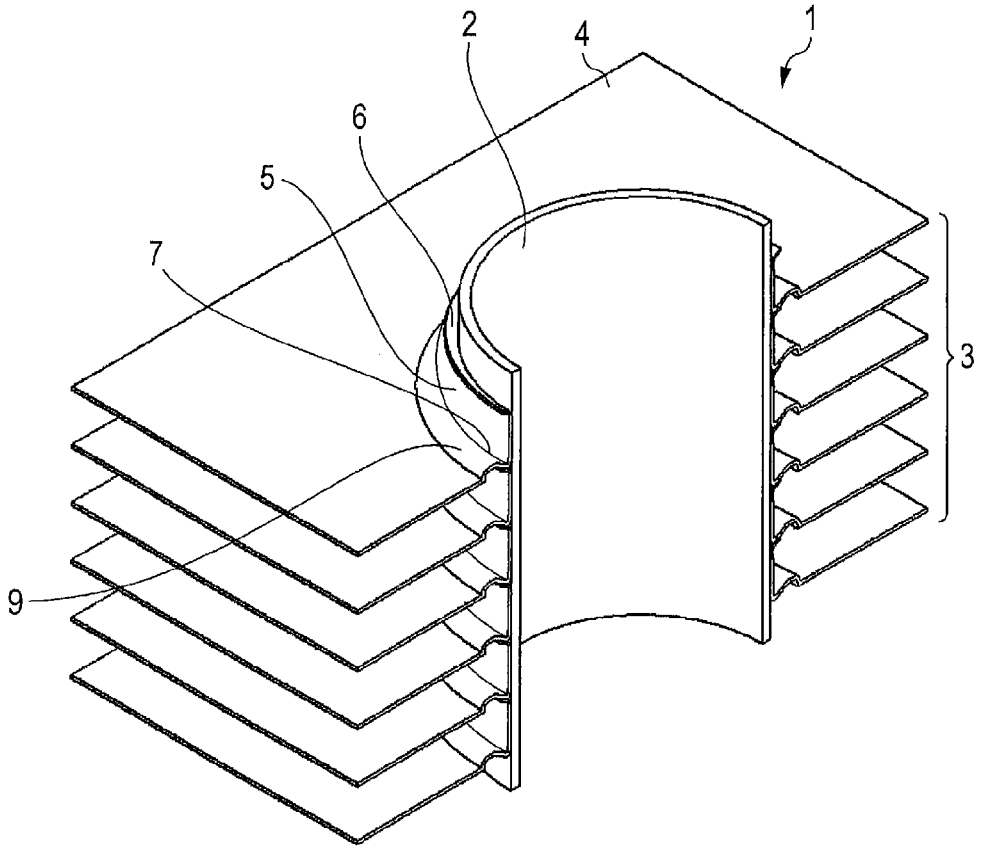
FIG. 8 is an enlarged perspective sectional view illustrating an exemplary configuration of a heat exchanger according to Embodiment 2.

In Embodiment 2, heat transfer fin 3 includes a step part protruding from base part 4 toward flare part 6 side. FIG. 8 is an enlarged perspective sectional view illustrating an exemplary configuration of heat exchanger 1 according to Embodiment 2.

Heat exchanger 1 according to Embodiment 2 differs from heat exchanger 1 illustrated in FIG. 2 in that heat exchanger 1 of FIG. 8 is provided with step part 9. Step part 9 houses flare part 6 of heat transfer fin 3 on the lower side. With this configuration, lateral shifting of heat transfer fins 3 can be reduced.

Figure 9:
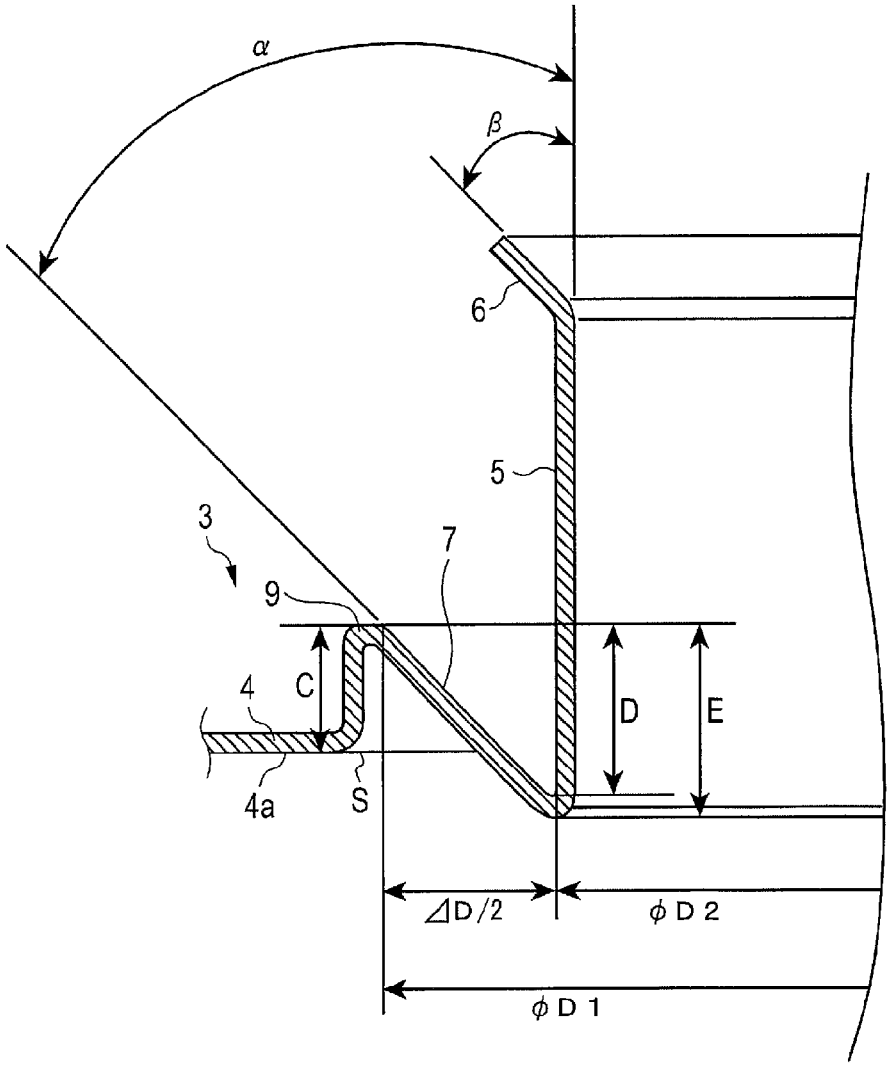
FIG. 9 shows dimensions of components of a heat transfer fin.

FIG. 9 illustrates the dimensions of the components of heat transfer fin 3. As in FIG. 4, D represents the depth of the groove defined between collar part 5 and recession part 7, φD1 represents the outermost peripheral diameter of the groove, and φD2 represents the outermost peripheral diameter of collar part 5. The difference between the outermost peripheral diameter of the groove and the outermost peripheral diameter of the collar part 5, that is φD1-φD2 is represented by ΔD. In this case, the width of the groove is ΔD/2.

In addition, the height of step part 9 is represented by C. Height C is a distance from reference surface S in contact with surface 4*a* of base part 4 on the side opposite to flare part 6 to the uppermost part of step part 9. In addition, distance E represents the distance from the root of collar part 5 to a position in collar part 5 that corresponds to the height of the uppermost part of step part 9. In this case, the root of collar part 5 is located at a position exceeding reference surface S, and therefore E>C is satisfied.

As described, also in the case where step part 9 is provided, heat transfer fin 3 is formed such that the root of collar part 5 is located at a position lower than reference surface S, and the contacting part between flare part 6 and recession part 7 is exposed to the air duct between heat transfer fins 3 through which air flows. Thus, heat dissipation can be effectively performed, and heat exchange performance is improved.

In addition, also in the case where step part 9 is provided, it is desirable to set depth D of the groove formed between collar part 5 and recession part 7 in consideration of efficiency of heat dissipation. To be more specific, also in this case, a relationship similar to that illustrated in FIG. 6 is obtained, and therefore it is desirable to set depth D of the groove to a value equal to or lower than (ΔD/2). Thus, it is possible to prevent the region where the air velocity is 0 from being formed at the bottom of the groove.

Embodiment 3

Figure 10:
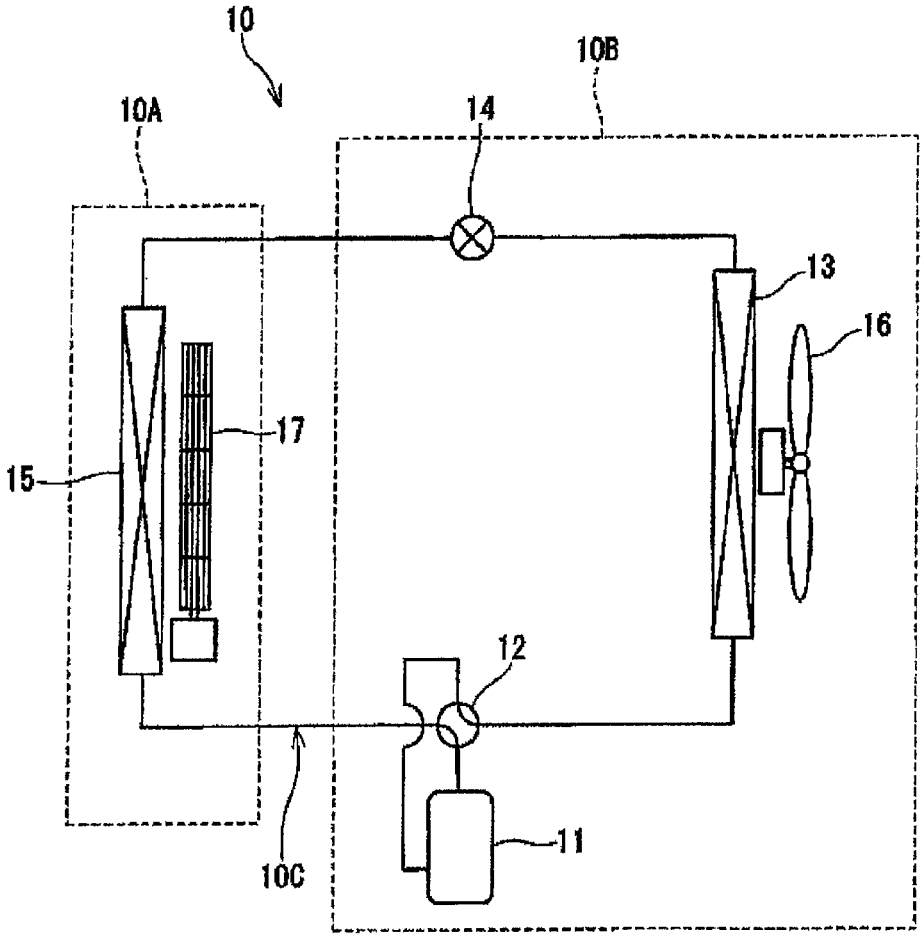
FIG. 10 illustrates an exemplary configuration of a refrigeration cycle apparatus in which a heat exchanger is used.

Next, a case where heat exchanger 1 of Embodiment 1 or 2 is applied in a refrigeration cycle apparatus is described. FIG. 10 illustrates an exemplary configuration of refrigeration cycle apparatus 10 in which heat exchanger 1 is used. For example, a heat pump apparatus such as a room air conditioner is an example of refrigeration cycle apparatus 10.

Refrigeration cycle apparatus 10 illustrated in FIG. 10 includes indoor unit 10A and outdoor unit 10B. Indoor unit 10A and outdoor unit 10B are connected together with refrigerant circuit 10C for flowing refrigerant.

Indoor unit 10A includes indoor heat exchanger 15, and indoor fan 17 that sends indoor air to indoor heat exchanger 15. An example of indoor fan 17 is a crossflow fan.

Outdoor unit 10B includes compressor 11, four-way valve 12, outdoor heat exchanger 13, diaphragm apparatus 14, and outdoor fan 16. Examples of compressor 11, diaphragm apparatus 14, and outdoor fan 16 are a rotary-type compressor, an expansion valve, and a propeller fan, respectively.

Duding heating operation, refrigerant having a high temperature and a high pressure which is compressed by compressor 11 is sent to indoor heat exchanger 15 by the action of four-way valve 12. Indoor heat exchanger 15 serves as a condenser, and warms indoor air guided by indoor fan 17 with refrigerant having a high temperature and a high pressure. At this time, the temperature of the refrigerant is reduced by the indoor air, and the refrigerant is condensed.

Then, the refrigerant thus condensed is sent to diaphragm apparatus 14. The refrigerant is adiabatically expanded by the action of diaphragm apparatus 14, and the resulting refrigerant having a low temperature and a low pressure is sent to outdoor heat exchanger 13.

Outdoor heat exchanger 13 serves as an evaporator, and warms the resulting refrigerant having a low temperature and a low pressure with the outdoor air guided by outdoor fan 16. At this time, the refrigerant is evaporated, and the evaporated refrigerant is again compressed by compressor 11. During heating operation, the above-mentioned change of the state of the refrigerant is repeated.

During cooling operation, refrigerant having a high temperature and a high pressure compressed by compressor 11 is sent to outdoor heat exchanger 13 by the action of four-way valve 12. Outdoor heat exchanger 13 serves as a condenser, and cools outdoor air guided by outdoor fan 16 with the refrigerant having a low temperature and a low pressure. At this time, the temperature of the refrigerant is reduced by the outdoor air and the refrigerant is condensed.

Then, the refrigerant thus condensed is sent to diaphragm apparatus 14. The refrigerant is adiabatically expanded by the action of diaphragm apparatus 14, and the resulting refrigerant having a low temperature and a low pressure is sent to indoor heat exchanger 15.

Indoor heat exchanger 15 serves as an evaporator, and cools the indoor air guided by indoor fan 17 with the refrigerant having a low temperature and a low pressure. At this time, the refrigerant is evaporated, and the evaporated refrigerant is again compressed by compressor 11. During cooling operation, the above-mentioned change of the state of the refrigerant is repeated.

In Embodiment 3, heat exchanger 1 of Embodiment 1 or Embodiment 2 is applied as at least one of outdoor heat exchanger 13, and indoor heat exchanger 15. With such a configuration, heat exchange efficiency of an evaporator or a condenser is improved. As a result, the coefficient of performance (COP) of refrigeration cycle apparatus 10 is improved.

This application is entitled to and claims the benefit of Japanese Patent Application No. 2013-081203 dated Apr. 9, 2013, the disclosure of which including the specification, drawings and abstract is incorporated herein by reference in its entirety.

INDUSTRIAL APPLICABILITY

The heat transfer fin, the heat exchanger, and the refrigeration cycle apparatus according to the embodiments of the present invention are suitable for a heat pump apparatus of a room air conditioner, a water heater, a heater or the like, for example.

REFERENCE SIGNS LIST

1 Heat exchanger
2 Heat transfer tube
3 Heat transfer fin
4 Base part
4*a* Surface
5 Collar part
6 Flare part
6*a* Inclined surface
7 Recession part
7*a* Inclined surface
8 Gap
9 Step part
10 Refrigeration cycle apparatus
10A Indoor unit
10B Outdoor unit
10C Refrigerant circuit
11 Compressor
12 Four-way valve
13 Outdoor heat exchanger
14 Diaphragm apparatus
15 Indoor heat exchanger
16 Outdoor fan
17 Indoor fan
20 Side plate
21 Bend tube
30 Upper boundary of air duct
31 Lower boundary of air duct
32 Surface of collar part
100 Heat exchanger
110 Heat transfer tube
120 Heat transfer fin
121 Base part
122 Root part
123 Collar part
124 Flare part
125 Step part
130 Gap

The invention claimed is:

1. A heat transfer fin that is used for a heat exchanger, the heat transfer fin comprising: a plate-shaped base part; a collar part having a tubular shape that is provided in an upright state with respect to the base part; a recession part that includes an inclined surface configured to couple a root of the collar part with the base part; and a flare part that expands outward from an end of the collar part in a radial direction of the collar part over a whole circumference, the flare part being configured to make surface contact with an inclined surface of another heat transfer fin when the heat transfer fin is coupled with the other heat transfer fin used for the heat exchanger, wherein the inclined surface of the recession part and the root of the collar part are coupled with each other, a coupling part between the inclined surface of the recession part and the collar part is bent at an acute angle, and the root of the collar part is located at a position exceeding a reference surface that is in contact with a surface of the base part, the surface of the base part facing away from the flare part, wherein a depth D of a groove that is formed at the coupling part bent at an acute angle satisfies $0<D<AD/2$, wherein AD represents a difference between an outermost peripheral diameter of the groove and an outermost peripheral diameter of the collar part.

2. The heat transfer fin according to claim 1, wherein the flare part has an inclination angle with respect to a tube-axial direction of the collar part that is equal to or smaller than an inclination angle of the inclined surface of the recession part with respect to the tube-axial direction of the collar part.

3. The heat transfer fin according to claim 1 further comprising a step part that protrudes from the base part toward the flare part at a position between the base part and the recession part.

4. A heat exchanger comprising: a plurality of stacked heat transfer fins; and a heat transfer tube that penetrates the plurality of heat transfer fins, each heat transfer fin including: a plate-shaped base part, a collar part having a tubular shape that is provided in an upright state with respect to the base part, a recession part that includes an inclined surface configured to couple a root of the collar part with the base part, and a flare part that expands outward from an end of the collar part in a radial direction of the collar part over a whole circumference, the flare part being configured to make surface contact with an inclined surface of the recession part of another heat transfer fin when the heat transfer fin is coupled with the other heat transfer fin, wherein the inclined surface of the recession part and the root of the collar part are coupled with each other, a coupling part between the inclined surface of the recession part and the collar part is bent at an acute angle, and the root of the collar part is located at a position exceeding a reference surface that is in contact with a surface of the base part, the surface of the base part facing away from the flare part, wherein a depth D of a groove that is formed at the coupling part bent at an acute angle satisfies $0<D<AD/2$, wherein AD represents a difference between an outermost peripheral diameter of the groove and an outermost peripheral diameter of the collar part.

5. The heat exchanger according to claim 4, wherein the flare part has an inclination angle with respect to a tube-axial direction of the collar part that is equal to or smaller than an inclination angle of the inclined surface of the recession part with respect to the tube-axial direction of the collar part.

6. The heat exchanger according to claim 4 further comprising a step part that protrudes from the base part toward the flare part at a position between the base part and the recession part.

7. A refrigeration cycle apparatus in which a refrigeration cycle is configured such that refrigerant circulates through a compressor, a condenser, a diaphragm apparatus and an evaporator, wherein at least one of the condenser and the evaporator includes the heat exchanger according to claim 4.

* * * * *